US007823244B2

(12) United States Patent
Knopow et al.

(10) Patent No.: US 7,823,244 B2
(45) Date of Patent: Nov. 2, 2010

(54) NUBBY MITT FOR DEBRIS REMOVAL

(75) Inventors: Jeremy F. Knopow, Oak Creek, WI (US); Steven A. Zach, Racine, WI (US); Chrissie M. Smits, Oak Creek, WI (US); Douglas P. Gundlach, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 1016 days.

(21) Appl. No.: 11/107,507

(22) Filed: Apr. 15, 2005

(65) Prior Publication Data

US 2006/0230559 A1 Oct. 19, 2006

(51) Int. Cl.
*A47L 25/00* (2006.01)

(52) U.S. Cl. ..... 15/227; 15/104.002; 15/114

(58) Field of Classification Search ..... 15/227, 15/209.1, 210.1, 231, 104.002, 114, 104.5–104.54, 15/1.51; 119/612–615, 625–628, 632–633; 132/119

See application file for complete search history.

(56) References Cited

U.S. PATENT DOCUMENTS

| | | | | |
|---|---|---|---|---|
| 277,173 | A | | 5/1883 | Thompson |
| 671,296 | A | | 4/1901 | Rowand |
| 1,403,817 | A | | 1/1922 | Pinson |
| 1,497,035 | A | | 6/1924 | Skoglund |
| 1,583,606 | A | | 5/1926 | Roussel |
| 1,783,788 | A | | 12/1930 | Hatchett, Sr. |
| 2,034,169 | A | | 3/1936 | Alefantis |
| 2,101,027 | A | | 12/1937 | Karger |
| 2,103,455 | A | | 12/1937 | Greenwald |
| 2,480,097 | A | * | 8/1949 | Holden ..... 601/155 |
| 2,550,092 | A | | 4/1951 | Sitek |
| 2,651,071 | A | | 9/1953 | Dyer et al. |
| 2,702,913 | A | | 3/1955 | Walkama |
| 2,715,742 | A | | 8/1955 | Coles |
| 2,724,847 | A | | 11/1955 | Krasno |
| 3,056,154 | A | | 10/1962 | Neal |
| 3,058,154 | A | | 10/1962 | Neal |
| 3,103,029 | A | | 9/1963 | Valles |
| 3,151,333 | A | | 10/1964 | Scholz |
| 3,321,790 | A | | 5/1967 | Hand |
| 3,330,077 | A | | 7/1967 | Kanbar et al. |
| 3,389,416 | A | | 6/1968 | Timms |
| 3,471,977 | A | | 10/1969 | Roth |
| 3,643,386 | A | | 2/1972 | Grzyll |
| 3,742,547 | A | | 7/1973 | Sohmer |
| 3,747,152 | A | | 7/1973 | Tsuruzawa |
| 3,772,722 | A | | 11/1973 | Gellert |
| 3,883,921 | A | | 5/1975 | Thettu et al. |

(Continued)

FOREIGN PATENT DOCUMENTS

| | | |
|---|---|---|
| EP | 0586036 | 3/1994 |

(Continued)

*Primary Examiner*—Laura C Guidotti
(74) *Attorney, Agent, or Firm*—Boyle Fredrickson, S.C.

(57) ABSTRACT

A fabric cleaning device (20) is disclosed. The fabric cleaning device (20) includes a hand held support (22) having a plurality of loosening projections (50) associated therewith, and a resilient pad (26) comprising a plurality of individual flexible cleaning sheets (60) receiving the loosening projections (50) and having an affinity for debris.

20 Claims, 3 Drawing Sheets

U.S. PATENT DOCUMENTS 3,885,249 A 5/1975 De Brabander
3,906,578 A 9/1975 Huber
3,967,338 A 7/1976 Russell
3,982,298 A 9/1976 Ota
4,038,787 A 8/1977 Bianchi
4,042,995 A 8/1977 Varon
4,062,083 A 12/1977 McKay
4,103,382 A 8/1978 Gitt
4,107,840 A 8/1978 Kupperman et al.
D251,022 S 2/1979 McKay
4,161,050 A * 7/1979 Sasaki et al. ..... 15/207.2
4,225,997 A 10/1980 Thomas et al.
4,294,597 A 10/1981 Archer et al.
4,361,923 A 12/1982 McKay
4,399,579 A 8/1983 McKay
4,422,201 A 12/1983 McKay
4,427,726 A 1/1984 Wolfrum
D273,058 S 3/1984 McKay
D273,059 S 3/1984 McKay
D276,763 S 12/1984 McKay
4,557,011 A 12/1985 Sartori
4,570,280 A 2/1986 Roth
4,575,890 A 3/1986 Hidle
4,593,427 A 6/1986 Ortolivo
4,621,388 A 11/1986 Ortolivo
4,642,835 A 2/1987 Schmitz
4,670,930 A 6/1987 Lu
4,703,538 A 11/1987 Silverstrone
4,713,274 A 12/1987 Minor
4,727,616 A 3/1988 Kucera et al.
D295,833 S 5/1988 Roth
4,797,967 A 1/1989 Lengers
4,847,937 A 7/1989 Gorski
4,850,073 A 7/1989 Preuss
4,884,374 A 12/1989 Natale et al.
4,905,337 A 3/1990 McKay
4,979,257 A 12/1990 Heneveld
4,980,943 A 1/1991 Barber
5,008,969 A 4/1991 Jarrett
5,009,195 A 4/1991 Damm
5,010,617 A 4/1991 Nelson
D317,083 S 5/1991 Chou
5,027,465 A 7/1991 McKay
5,036,561 A 8/1991 Calafut
5,130,185 A * 7/1992 Ness ..... 428/41.9
5,134,746 A 8/1992 William
5,148,571 A 9/1992 Brazis et al.
5,280,664 A 1/1994 Lin
5,333,341 A 8/1994 Heneveld
5,419,014 A 5/1995 Piantedosi
5,441,355 A 8/1995 Moore
D362,965 S 10/1995 Tastanis
5,524,575 A 6/1996 Lennon
5,525,397 A 6/1996 Shizuno et al.
5,553,344 A 9/1996 Rosenkrantz
5,569,521 A 10/1996 Francoeur, Sr. et al.
5,577,273 A 11/1996 Newkirk et al.
5,600,865 A 2/1997 Morrison
D384,058 S 9/1997 Pinon
5,673,435 A 10/1997 Gebhard
5,682,837 A 11/1997 Courtney et al.
5,742,969 A 4/1998 Thomas et al.
5,763,038 A 6/1998 Wood
5,768,709 A 6/1998 Newkirk et al.
5,783,034 A 7/1998 Urso
5,829,089 A 11/1998 Steadman
5,878,439 A 3/1999 Waters, Jr.
5,878,457 A 3/1999 Cox et al.
5,894,623 A 4/1999 Thill
D411,048 S 6/1999 Pinon
5,956,770 A 9/1999 Dennis
D417,551 S 12/1999 Pinchuk
6,014,788 A 1/2000 Jaffri
6,016,571 A 1/2000 Guzman et al.
6,021,542 A 2/2000 Norman
6,024,970 A 2/2000 Woodard
6,055,695 A 5/2000 McKay, Jr.
6,109,214 A 8/2000 Rampersad
6,127,014 A 10/2000 McKay, Jr.
6,192,543 B1 2/2001 Lee
D439,387 S 3/2001 Ancona et al.
6,233,854 B1 5/2001 Levy et al.
6,241,580 B1 6/2001 Fisher
D446,368 S 8/2001 Pizarro
6,292,948 B1 9/2001 Chen
6,305,843 B1 10/2001 Helmer
6,319,478 B1 11/2001 McKay, Jr.
6,405,403 B1 6/2002 McKay
6,425,136 B1 7/2002 Schlamp et al.
6,427,278 B1 8/2002 McKay, Jr.
6,427,633 B1 8/2002 Ogden
D463,134 S 9/2002 Vosbikian
6,449,794 B1 9/2002 Jaffri
6,460,191 B1 10/2002 Lorkovic
D467,736 S 12/2002 Russell
D468,540 S 1/2003 Jessen
6,530,108 B1 3/2003 Brown et al.
6,557,178 B1 5/2003 Hoover
6,560,813 B2 5/2003 Brown et al.
D483,570 S 12/2003 Heidel et al.
D483,952 S 12/2003 Thompson et al.
6,687,942 B1 2/2004 Pember
6,688,464 B2 2/2004 Jessen et al.
6,698,626 B2 3/2004 McKay
6,735,806 B2 5/2004 Blum et al.
D490,952 S 6/2004 Ajluni
6,763,977 B2 7/2004 McKay
6,829,802 B2 12/2004 McKenzie
6,834,619 B1 12/2004 Rampersad
6,842,934 B1 1/2005 McKay, Jr. et al.
7,309,182 B2 * 12/2007 McKay ..... 401/138
7,364,380 B2 * 4/2008 McKay ..... 401/138
2002/0078488 A1 6/2002 Lorkovic
2002/0124335 A1 9/2002 Franko, Sr.
2002/0157977 A1 10/2002 Reid-Killings et al.
2003/0039822 A1 2/2003 Aalbers
2003/0049407 A1 3/2003 Kacher et al.
2003/0089632 A1 5/2003 Jessen et al.
2003/0135941 A1 7/2003 Vosbikian
2003/0154569 A1 8/2003 McKay
2003/0209564 A1 11/2003 McKay
2003/0209565 A1 11/2003 McKay
2003/0229958 A1 12/2003 Thompson et al.
2004/0052570 A1 3/2004 McKay
2004/0134003 A1 7/2004 McKay, Jr.
2004/0177459 A1 9/2004 McKay
2004/0177461 A1 9/2004 Ajluni
2004/0182886 A1 9/2004 McKay
2004/0194240 A1 10/2004 McKay, Jr.
2005/0026759 A1 2/2005 McKay, Jr. et al.
2005/0217045 A1 10/2005 Minkler et al.
2005/0241088 A1 11/2005 Brunner et al.
2005/0241089 A1 11/2005 Brunner et al.

FOREIGN PATENT DOCUMENTS

EP 0966915 12/1999
EP 0969758 B1 1/2000
GB 2103074 2/1983
GB 2103470 2/1983
GB 2220841 1/1990
GB 2263393 1/1992
GB 2257618 1/1993
JP 2-71721 3/1990

| | | | | |
|---|---|---|---|---|
| JP | 5-211984 | | | 8/1993 |
| JP | 2000-287910 | | | 10/2000 |
| JP | 2002-369781 | A | * | 12/2002 |
| JP | 2003000510 | | | 1/2003 |
| WO | WO98/36677 | | | 8/1998 |
| WO | WO 00/23535 | | | 4/2000 |
| WO | WO03/015601 | | | 2/2003 |
| WO | WO03/015602 | | | 2/2003 |
| WO | WO03/041558 | | | 5/2003 |
| WO | WO03/104119 | | | 12/2003 |
| WO | WO03/105656 | | | 12/2003 |
| WO | WO 2004/087825 | | | 10/2004 |

* cited by examiner

NUBBY MITT FOR DEBRIS REMOVAL

BACKGROUND OF THE INVENTION

1. Field of the Invention

The present invention relates to the field of fabric cleaning devices such as lint collectors. More particularly, the present invention relates to a mitt having a nubbed cleaning surface and a removable adhesive layer for surface cleaning household fabrics.

2. Discussion of the Related Art

There are many previously known adhesive rollers for detritus removal. These previously known rollers typically comprise an elongated strip having a backing layer. The strip includes two ends and two spaced-apart and parallel side edges. An adhesive layer is provided along a first side of the backing layer. Thereafter, the strip is wound into a tubular and cylindrical roll with the adhesive layer facing outwardly. Oftentimes the strip is wound about a tubular core and the tubular core is then rotatably mounted on a handle to facilitate rolling of the adhesive roller along the surface desired to be cleaned.

After prolonged use of the adhesive roller for cleaning surfaces, the adhesive on the outermost layer or sheet of the adhesive roller becomes covered with detritus and other matter and loses its adhesiveness. When this happens, it is necessary to remove the outermost sheet of the adhesive roller to expose fresh adhesive on the next underlying sheet of the roller.

In general, the majority of improvements to these known adhesive debris removers have been directed at improving the basic mechanical components of the typical lint roller. These improvements have generally been directed at providing an inexpensive yet robust implement for lint rolling. However, notably absent in the prior art is any attempt to provide an alternative mechanism for fabric cleaning that deviates substantially from the basic mechanical structure of the lint roller.

Presently, there exist several disadvantages to using these previously known adhesive rollers. Many of the known lint rollers do not have a means for loosening the debris that is firmly attached to a fabric. For instance, lint, pet or human hair may become attached or intertwined to the fabric of a piece of furniture such that the adhesive force of the roller alone is not sufficient to remove it from the fabric. This problem is commonly seen in furniture that includes a rougher cross stitched fabric. Hair or other debris may become intertwined with the fabric stitching. In order to disengage the debris from the fabric, some additional frictional force is required. The smooth rolling motion of known lint rollers is not sufficient to achieve the required removal of such debris. In contrast, the pressure applied to the fabric in using known lint rollers merely presses the lint back into the fabric.

Similarly, the roller cannot be effectively used in hard to reach places such as between furniture cushions or other crevices. Most lint rollers cannot fit into tight spaces because they are too large. Likewise, the effective cleaning surface of many of the lint rollers is relatively small, such that use of these rollers on large surfaces requires considerable effort on the user's part.

Although the prior art discloses brushes with rubber bristles to remove pet hair from upholstery and pets, these brushes merely detach hair from the upholstery, but then require cleaning of the brush to remove the entangled hair. Many consumers dislike touching that hair and thus a self-cleaning brush is desirable that does not require a user to manually pick up and discard the collected debris.

SUMMARY AND OBJECTS OF THE INVENTION

Consistent with the foregoing, and in accordance with the invention as embodied and broadly described herein, a cleaning device, a mitt for cleaning a fabric, and a method of cleaning a household fabric are disclosed in suitable detail to enable one of ordinary skill in the art to make and use the invention.

In one embodiment, a cleaning device includes a support configured to be received by a human hand, a plurality of spaced-apart loosening projections operatively coupled with the support and extending outwardly therefrom, and a plurality of individual, adjacent, cleaning sheets receiving the loosening projections therethrough and releasably engaging the projections. The support may be in the form of a mitt and the loosening projections may be formed on a carrier attached to the mitt. The cleaning sheets may be mounted for manual lift-off removal of individual sheets from the loosening projections and have an affinity for debris. An adhesive is placed on at least one of the opposed faces of adjacent sheets of the pad to cause the sheets to remain in place until they are manually removed from the pad of sheets.

In an alternative embodiment, the loosening projections are formed on a carrier configured to be removably attached to the mitt. The sheets may include opposed upper and lower surface and the adhesive may be applied to both sides. The sheets of the pad may further include a tab portion for permitting manual grasping of a respective sheet for the lift-off removal thereof.

In one embodiment, the loosening projections comprise elongated, flexible elements. The loosening projections may be integral with the carrier. In yet another embodiment, the mitt includes a pair of opposed thumb holes to accommodate a left or right handed user and the loosening projections are comprised of bundles of a plurality of attached individual nub members.

In yet another alternative embodiment, a mitt for cleaning a fabric includes a plurality of spaced-apart nubs operatively coupled with the mitt and extending outwardly therefrom and a plurality of individual, apertured, face-to-face oriented cleaning sheets receiving the nubs therethrough and positioned proximal to the nubs. The cleaning sheets are mounted for individual manual lift-off removal thereof and having an affinity for debris. A retainer operably engages the sheets for retaining the same in place until the manual removal thereof.

In another embodiment, the nubs are formed on a carrier configured to be removably attached to the mitt and attached to the mitt by hook-and-loop fasteners. The nubs may be comprised of bundles of a plurality of attached individual nub members. In one embodiment, the mitt includes a pair of opposed thumb holes to accommodate a left or right handed user.

In still another embodiment, a method of cleaning a household fabric includes attaching a support to the hand of a user, operatively coupling a plurality of spaced-apart loosening projections with the support, releaseably engaging the projections with a resilient pad that includes a plurality of cleaning sheets and moving the mitt across the fabric such that the plurality of loosening projections engage the surface and the cleaning sheets assist in cleaning the surface.

In another embodiment, the method further includes the step of removing an outermost cleaning sheet to reveal a new cleaning sheet. In yet another embodiment, the nubs are formed on a carrier configured to be removably attached to the mitt and the carrier is attached to the mitt by hook-and-loop fasteners.

In a final embodiment a hand held cleaning device includes a plurality of spaced-apart loosening projections operatively coupled with a cleaning surface of the device and extending outwardly therefrom and a plurality of individual, adjacent cleaning sheets receiving the loosening projections therethrough and releasably engaging the projections.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
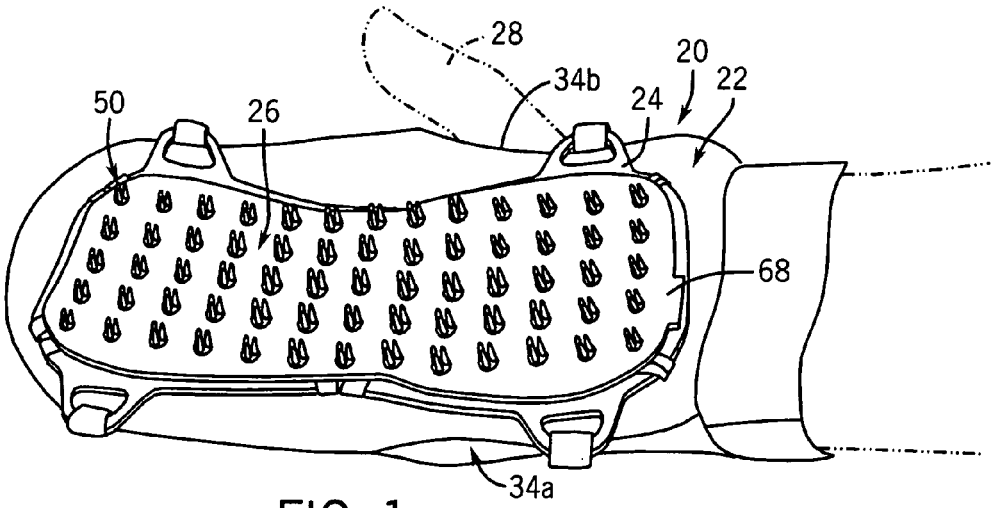
FIG. 1 is a perspective view of a first embodiment of the cleaning mitt showing a user's hand in phantom.
Figure 1A:
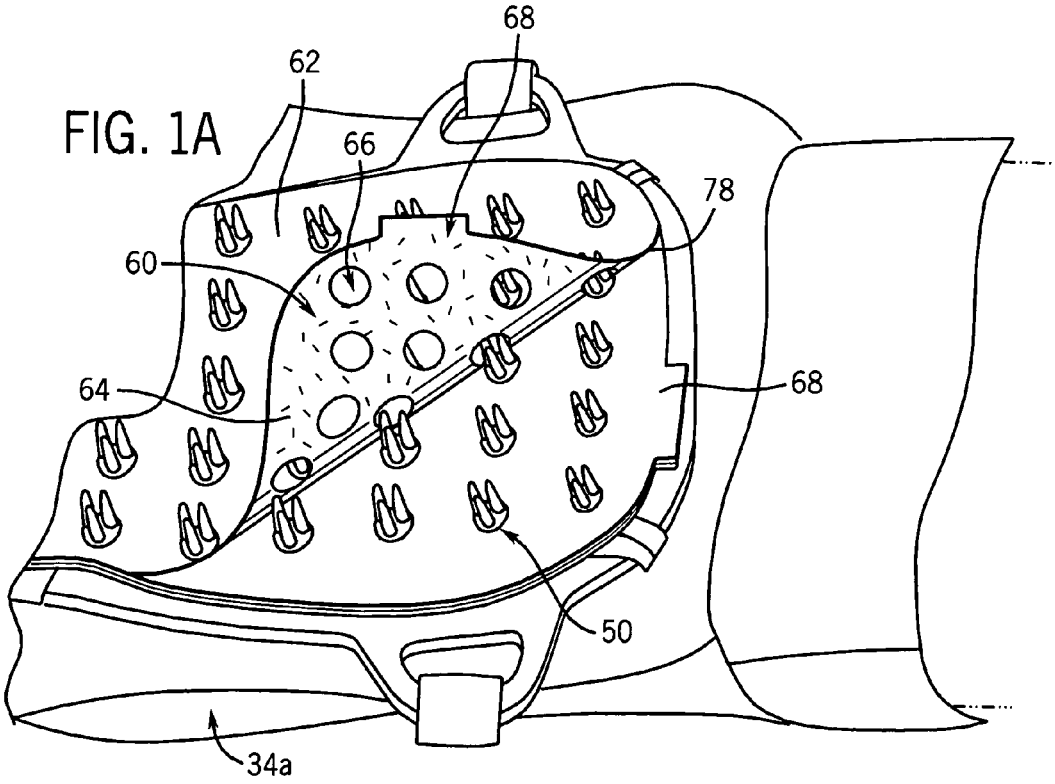
FIG. 1A is a partial cut away of the perspective view in FIG. 1, illustrating the plurality of individual cleaning sheets.

In describing the preferred embodiment of the invention, which is illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the word connected or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

In a basic form, the invention is a fabric cleaning device that includes a support configured to be attached to or received by a hand having a plurality of loosening projections associated therewith, and a resilient pad comprising a plurality of individual flexible cleaning sheets. The sheets receive the loosening projections and have an affinity for debris. The cleaning device allows a user to remove hair and other debris from household fabrics in a manner that exhibits greater control and versatility than traditional lint rollers.

2. Detailed Description of Preferred Embodiments

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the below examples should not be construed as limiting the scope of the present invention.

Figure 2:
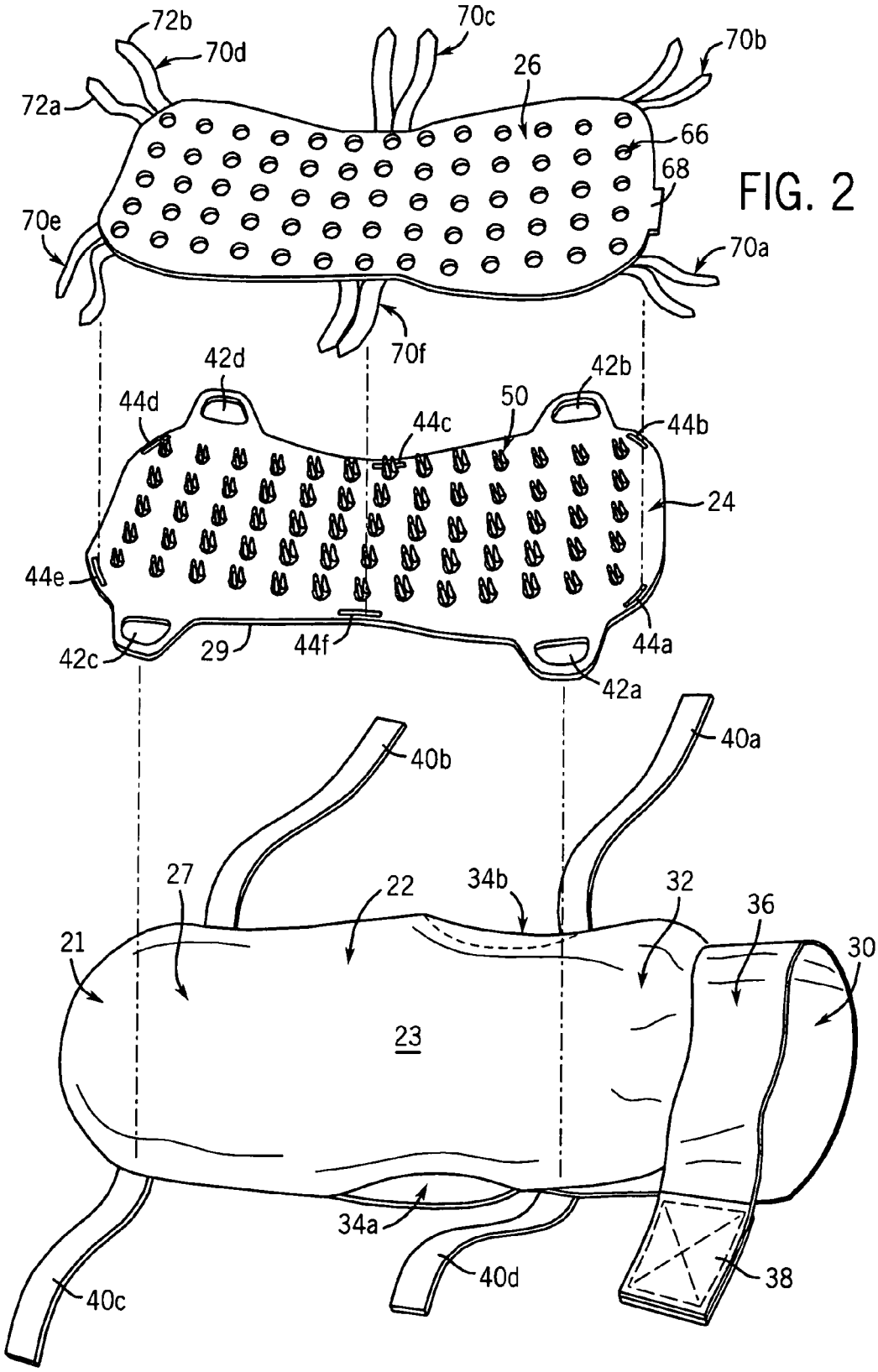
FIG. 2 is an exploded perspective view of the component parts of the cleaning mitt illustrated in FIG. 1.

Turning initially to FIGS. 1 and 2, the inventive cleaning device 20 is illustrated according to one preferred embodiment of the present invention. Cleaning device 20 is generally comprised of a support 21 configured to be attached to or received by a hand. In the illustrated embodiment the support may be a glove or mitt 22, having a plurality of loosening projections, fingers or nubs 50 attached, and a resilient pad 26 configured to fit over the loosening projections 50.

Mitt 22 is sleeve like member configured to receive the hand 28 (in phantom) of a user. Mitt 22 includes a body 23 that defines an internal passage 30 and an external surface 32 and a wristband 36. A pair of thumb holes 34*a*, 34*b* are located on opposed sides of the mitt 22 to allow the passage of a user's thumb. In the illustrated embodiment, an elastic wristband 36 with a securing flap 38 is attached to the mitt body 23. The wristband 36 and securing flap 38 preferably include mating hook and loop fasteners or other known attachment means for adjusting the wristband 36 to securely fit around the hand of a wide variety of users. The mitt 22 preferably fits snugly to permit effective swiping of the upholstery, clothing, carpet or other fabric surfaces with the mitt 22 without it rotating about the user's hand. The opposed thumb holes 34*a*, 34*b* and adjustable wristband 36 make the mitt 22 universal for left and right handed individuals of all sizes. It is recognized that a variety of known alternative adjustment mechanisms could be provided on the mitt 22. For example, buttons, zippers, grommets or ties could also be utilized.

Mitt 22 may be constructed from a variety of known materials. In the preferred embodiment, mitt is constructed from common synthetic fibers such as polyester or nylon. Mitt 22 may alternatively be constructed from other materials as is known in the art. In the illustrated embodiment four carrier attachment straps 40*a-d* are spatially dispersed along the edge of the mitt 22 and configured to mate with spaced attachment pads 41. Carrier attachment straps 40*a-d* are preferably include hook and loop fasteners such as Velcro® and are configured to fit through the openings 42*a-d* on the carrier 24 to secure the carrier 24 to the mitt 22. Alternatively, the straps 40*a-d* may be omitted and hook and loop fastener pads can be permanently applied to the front face 27 of the mitt 22 to fasten in a face-to-face manner with a pad of loops permanently attached to the backside 29 of the carrier 24. The hooks and the loops can be interchanged if desired on the mitt 22 and carrier 24.

In the illustrated embodiment, the internal passage 30 of mitt 22 is open. However, it is recognized that a variety of alternative constructions can be used consistent with the present invention. For example, internal passage 20 of the mitt 22 could include a plurality of finger holes or slots to increase overall control and maneuverability of the device. Alternatively, the mitt 22 could be constructed in the form of a glove with separate finger sleeves.

Figure 3:
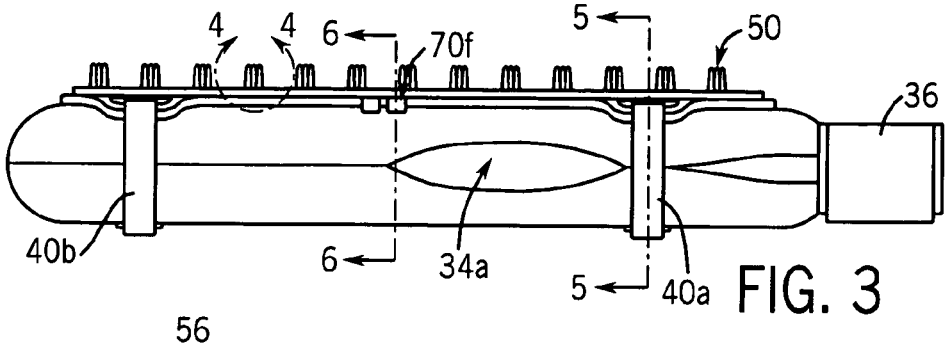
FIG. 3 is a side view of the cleaning mitt illustrated in FIG. 1.
Figure 5:
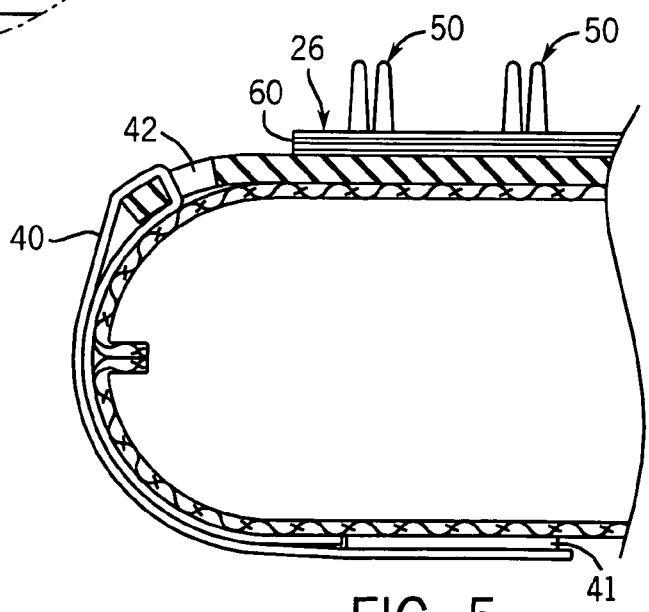
FIG. 5 is a sectional view taken along line 5-5 of FIG. 3.

Removably attached to the mitt 22 via attachment straps 40*a-d* is the carrier 24. Carrier 24 is a generally rectangular, flexible, resilient member defining four carrier strap attachment openings 42*a-d* and six spaced pad strap receiving slots 44*a-f* As illustrated in FIGS. 1, 3 and 5, carrier straps 40*a-d* can be inserted through the carrier strap attachment openings 42*a-d* and attached to the body 23 of the mitt 22. In the illustrated embodiment, the carrier straps 40*a-d* include a hook and loop fastener on one side of the straps configured to mate with attachment pads 41 located on the mitt body. A variety of known alternative fastening mechanisms could also be utilized such as, buttons, snaps or straps to secure the carrier 24 to the mitt 22. Carrier 24 includes a plurality of spaced loosening projections or nubs 50 configured to engage a fabric surface to be cleaned.

Carrier 24 may be formed from a variety of materials with a low-durometer[0] such as elastomers. In the preferred embodiment, carrier 24 is constructed from rubbery materials that have a grippy surface that helps grab hair. Suitable materials could include, for example, natural rubber, synthetic rubber such as styrene-butadiene and nitrile, silicone rubber, or thermoplastic elastomers including ethylene-propylene copolymers, and ethylene-propylene diene (EPDM) rubber. The softer materials are preferred because they are less likely to snag threads from upholstery and conform easily to the bends of the human hand.

It should be recognized that although the carrier 24 is illustrated as being removably attached to the mitt 22, carrier 24 could alternatively be formed into or permanently affixed to the mitt 24. Likewise, carrier 24 could be completely omitted and pad 26 could be attached to a mitt 22 including loosening projections 50.

Figure 4:
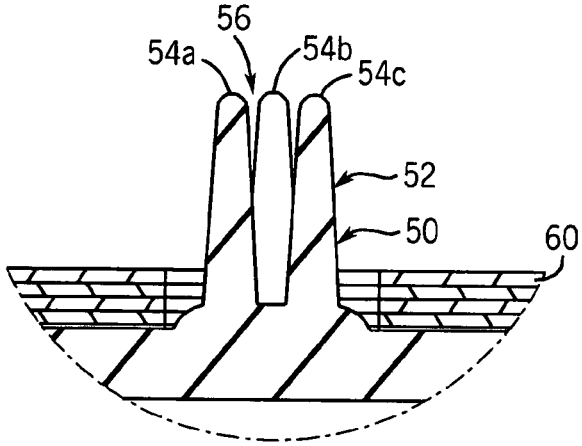
FIG. 4 is a sectional view taken along line 4-4 of FIG. 3.
Figure 6:
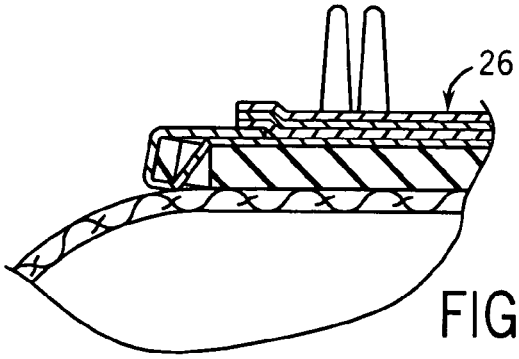
FIG. 6 is a sectional view taken along line 6-6 of FIG. 3.

Turning now to FIGS. 4-6, the preferred loosening projections or nubs 50 are illustrated. Loosening projections 50 are preferably comprised of bundles 52 of individual pointed projections or nubs 54*a-c*. In the illustrated embodiment, each bundle 52 is comprised of three individual projections 54*a-c*. It is recognized, however, that any number of individual projections could be utilized consistent with the present invention. The plurality of individual projections 54*a-c* create gaps or spaces 56 between the individual projections 54*a-c*. The gaps 56 are useful in trapping human or pet hair and other debris during cleaning and debris removal.

In the illustrated embodiment, the loosening projections 50 are integrally formed into the rubber carrier 24. This preferred embodiment provides a material that satisfactorily loosens the debris on the fabric, while at the same time preventing any damage to the material to be cleaned. The loosening projections 50 could alternatively be separately formed and attached to the carrier using known attachments. The loosening projections 50 could also be formed from a variety of alternative materials from the preferred synthetic resins. In one alternative, the loosening projections could be formed from elongated wire elements. Other materials could also be used such as, for example, wood or plastic.

Attached to the carrier 24 is a resilient pad 26. Pad 26 is preferably constructed from a plurality of individual adjacent, face to face orientated cleaning sheets 60. Cleaning sheets 60 include a front cleaning surface 62 and a rear surface 64. Preferably, the front cleaning surface 62 includes an adhesive for attracting and removing debris from the surface to be cleaned. While in the preferred embodiment a chemical adhesive is utilized, it is recognized that the sheets could further include some alternative means of attraction such as through the generation of an electrostatic charge to increase the adhesion of the debris to the cleaning sheets.

The resilient pad 26 may be permanently secured to the carrier 24, removably attached to the carrier 24, or directly attached to the mitt 22. In the illustrated embodiment, the pad 26 is connected to the carrier via a plurality of attachment straps 70*a-f*. Individual attachment straps 70*a-f* are shown comprising a first 72*a* and second 72*b* strap. Attachment straps 70*a-f* are configured to be inserted through pad strap receiving slots 44*a-f* to secure the pad 26 to the carrier 24. In the illustrated embodiment, the first 72*a* and second 72*b* straps are secured together using hook and loop fasteners. It is recognized that a vide variety of alternative mechanisms could be utilized to secure the first 72*a* and second 72*b* straps together. Likewise, a variety of alternative means could be utilized to secure the pad 26 to the carrier 24. For example, hook-and-loop opposing pads could be placed on the front face of mitt 22 and behind pad 26 or carrier.

In the illustrated embodiment, the pad 26 and individual sheets 60 are generally rectangular and configured to substantially align with the carrier 24. The individual sheets 60 include a plurality of spaced apertures 66 configured to receive the loosening projections 50 therethrough. The sheets 60 also include a tab portion 68 for permitting manual grasping of an individual sheet for lift off removal from the pad 26.

The pad 26 also includes a retaining means for maintaining the individual sheets 60 in place until the manual removal of the individual sheets 60. In the illustrated embodiment, the retaining means can be an adhesive applied to the rear surface 64 of the individual sheets 60. Such an adhesive would securely adhere the adjacent individual sheets 60 of the pad 26 together during the cleaning process. Alternatively, the outer edge 78 of the individual sheets 60 could include a plurality of perforations to seal the individual sheets together, or the sheets could be otherwise temporarily bound together using means that are known in the art. In another embodiment, the sheets 60 could be configured to flip over the mitt 22 and be kept as a stack on the back side of the mitt 22.

It should be recognized that both the front 62 and back 64 surface of the individual cleaning sheets 60 could be utilized for the cleaning process. The adhesive applied to the back side 64 of the cleaning sheets 60 could perform the dual purpose of adhering the individual sheets 60 to adjacent sheets as well as attracting debris during the cleaning process. It is preferred that the adhesive on the back side of the sheets 60 must be properly designed to aggressively capture, hold and dislodge pet hair, but still permit easy peeling of the sheets by the consumer.

Several alternatives are available consistent with the current disclosure. In one embodiment, the adhesive sheets 60 are firmly attached to the rubber carrier 24, with the projections protruding through the adhesive sheets 60. The carrier 24 is removably attached to the mitt 22 with a hook and loop fastener type mechanism between the backside of the carrier 24 and the mitt 22 itself. Thus the carrier 24 is disposable. A user just peels the carrier 24 off the mitt when all the adhesive sheets 60 are used up and replaces it with a new set of adhesive sheets 60 attached to a carrier 24. Likewise, the device 20 could be a wholly disposable product. For example, the device 20 could include a plastic mitt 22 that has the loosening projections 50 molded into it and a layer of adhesive sheets 60 attached. Once the adhesive sheets 60 are used up, the entire device 20 is disposed.

Methods of Use and Methods of Cleaning

It should be appreciated from the above disclosure that the preferred cleaning device 20 can be utilized to clean a variety of fabric surfaces. Due to the unique configuration of the device 20 and its integration with the hand of a user, a user can conveniently use the device to clean a variety of surfaces as well as manipulate the device to fit into narrow crevices and conform to curved upholstery.

In order to perform cleaning a user may obtain the above mentioned cleaning device 20. If the device 20 is not already assembled, a user may first secure the carrier 24 to the mitt 22 by inserting the attachment straps 40*a-d* through the carrier strap attachment openings 42*a-d* and thereby attaching the carrier 24 to the body 23 of the mitt 22. If the pad 26 is not attached to the carrier 24, a user may attach the pad 26 to the carrier 24 by inserting the attachment straps 70*a-f* through the pad strap receiving slots 44*a-f*.

The user then places the assembled device 20 onto a hand by inserting the hand into the internal passage 30 and inserting their thumb through one of the holes 34*a*, 34*b* located on opposed sides of the mitt 22. The user should insert their hand in a manner such that the attached carrier 24 and pad 26 are orientated beneath the palm of the user's hand. The user then secures the elastic wristband 36 around their wrist using the securing flap 38.

Once the cleaning device 20 has been secured to the user's hand, the user may begin cleaning the desired material. A user moves the mitt, with the carrier 24 and pad 26 engaging the surface to be cleaned. As the user moves mitt 22, the loosening projections 50 engage the surface, loosening any debris from the fibers of the cleaning surface. The debris then becomes trapped within the loosening projections 50, on the adhesive pad 26 or both. A preferred cleaning pattern consists of a side to side overlapping motion starting in the upper left hand (or right hand) side of the section to be cleaned, and progressing the wiping pattern across the surface to be cleaned continuing to use side to side wiping motions. Another preferred wipe pattern consists of an up-and-down wiping motion. The preferred wiping patterns allow the loosening projection to loosen debris and provide a better end result. Once the outer cleaning sheet has become saturated with debris, a user may remove the outer cleaning sheet by grasping it at the tab 68 and peeling it off from the adjacent layer.

This cleaning device 20 and method of use provides multiple benefits versus conventional lint rollers. The loosening projections 50 free a greater amount of debris resulting in an increase in total debris removal from traditional approaches. Additionally, since a fresh sheet 60 may be used every time, debris is trapped, removed and thrown away, promoting better hygiene. Conventional rollers, which are re-usable, can harbor dirt and germs, which can be spread throughout the household. Furthermore, unlike other rubber brush products, the device eliminates the tedious process of cleaning the tool. The peeling of the sheets 60 does that easily.

The cleaning sheets 60 are versatile in that they can be used for multiple cleanings and multiple surfaces. Each pad is designed to clean at least one average size surface (i.e., 2-3 adhesive layers to clean a 5 foot couch, or roughly 16 sq ft.) with an average debris load. The sheets can be changed sooner if surfaces are larger than average, or especially dirty.

It is understood that the component parts of the inventive device 20 described above may be manufactured and sold separately or together in the form of a cleaning system or kit. An initial kit may provide all of the component parts of the device including a pad 26 with twelve individual cleaning sheets 60. Replacement sheets may be sold separately. Likewise, the device 20 could be a wholly disposable product.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, as noted throughout the application the individual components need not be formed in the disclosed shapes, or assembled in the disclosed configuration, but could be provided in virtually any shape, and assembled in virtually any configuration, so as to provide for a cleaning device that includes a support having loosening projections and an adhesive layer attached. Although the support has been described as a mitt, the support could be any embodiment that is hand held with loosening projections protruding through adhesive layers. It could have a handle, or it could be a flat sheet with a piece of elastic to hold in place on the back of the hand (a hand "sandal"), etc.

Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

What is claimed is:

1. A cleaning device comprising:

a support configured to be received by a human hand;

a flexible carrier that is removably attached to the support by a fastener;

a plurality of frustoconical loosening projections grouped into bundles extending outwardly from the carrier, wherein loosening projections within a particular bundle are spaced to form gaps of decreasing width for trapping debris that is loosened by the projections;

a pad comprising a plurality of individual, adjacent cleaning sheets having holes, each hole receiving a corresponding bundle, the pad being removably attached to the carrier; and an adhesive applied to a front surface of each of the cleaning sheets, wherein the front surfaces of the respective sheets face outwardly with respect to the carrier, and wherein the adhesive collects debris that is loosened by the projections.

2. The cleaning device of claim 1, wherein the support is a mitt.

3. The cleaning device of claim 2, wherein the loosening projections are integral with the carrier.

4. The cleaning device of claim 2, wherein the mitt includes a pair of opposed thumb holes to accommodate a left or right handed user.

5. The cleaning device of claim 1, wherein the cleaning sheets are mounted for manual lift-off removal of individual sheets from the loosening projections.

6. The cleaning device of claim 5, wherein an adhesive is applied on the back surface of each of the cleaning sheets of the pad to cause the sheets to remain in place until manually sequentially removed from the pad.

7. The cleaning device of claim 6, wherein each of the sheets includes a tab portion for permitting manual grasping of a respective sheet for the lift-off removal thereof.

8. The cleaning device of claim 1, wherein loosening projections comprise elongated, flexible elements.

9. The cleaning device of claim 1, wherein the loosening projections are comprised of attached individual nub members.

10. The cleaning device of claim 1, wherein the support is a mitt having a pair of opposed thumb holes to accommodate a left or right handed user, wherein the loosening projections are integral with the carrier, wherein each of the sheets includes a tab portion for permitting manual grasping of a respective sheet for the lift-off removal thereof, and wherein the carrier is attached to the mitt by hook-and-loop fasteners.

11. The cleaning device of claim 1, wherein the loosening projections are integral with the carrier.

12. The cleaning device of claim 1, wherein each of the sheets includes a tab portion for permitting manual grasping of a respective sheet for the lift-off removal thereof, and wherein the carrier is attached to the mitt by hook-and-loop fasteners.

13. A mitt for cleaning a fabric comprising:

a plurality of frustoconical nubs grouped into spaced-apart bundles, the nubs being operatively coupled with the mitt and extending outwardly therefrom, wherein the bundles include gaps of decreasing width formed between adjacent nubs for trapping debris that is loosened by the nubs; and a plurality of individual, face-to-face oriented cleaning sheets having apertures for receiving bundles therethrough and positioned proximal to the nubs, wherein the cleaning sheets comprise a pad with each sheet being mounted for individual manual lift-off removal thereof and having an outwardly facing front surface with an adhesive for collecting debris, wherein the pad is removably attached to the mitt by a fastener.

14. The mitt of claim 13, wherein the nubs are on a carrier configured to be removably attached to the mitt.

15. The mitt of claim 14, wherein the carrier is attached to the mitt by hook-and-loop fasteners.

16. The mitt of claim 14, wherein the nubs are integral with the carrier.

17. The mitt of claim 13 further comprising an adhesive applied to respective inwardly facing back surfaces of the cleaning sheets.

18. The mitt of claim 13, wherein the mitt includes a pair of opposed thumb holes to accommodate a left or right handed user.

19. A hand held cleaning device comprising:

a plurality of frustoconical loosening projections grouped into spaced-apart bundles operatively coupled with a removable, flexible cleaning surface of the device and extending outwardly therefrom, wherein the bundles include gaps of decreasing width formed between adjacent projections for trapping debris that is loosened by the projections; and a pad comprising a plurality of individual, adjacent cleaning sheets having holes for receiving the bundles therethrough, the pad removably attached to the cleaning surface, wherein the individual sheets of the pad have an adhesive applied to an outwardly facing front surface for collecting debris.

20. The hand held cleaning device of claim 19 further comprising an adhesive applied to a back surface of each of the cleaning sheets.

* * * * *